United States Patent [19]

Pasternack

[11] Patent Number: 4,491,130

[45] Date of Patent: Jan. 1, 1985

[54] EMERGENCY RESPIRATOR

[75] Inventor: Adalbert Pasternack, Bad Schwartau, Fed. Rep. of Germany

[73] Assignee: Drägerwerk Aktiengesellschaft, Fed. Rep. of Germany

[21] Appl. No.: 442,791

[22] Filed: Nov. 18, 1982

[30] Foreign Application Priority Data

Dec. 19, 1981 [DE] Fed. Rep. of Germany ..... 3150412

[51] Int. Cl.[3] ..... A62B 7/08

[52] U.S. Cl. ..... 128/202.26; 128/204.15; 128/201.13

[58] Field of Search ..... 128/202.26, 205.12, 128/911, 201.13, 204.17, 203.28, 203.29, 204.13, 204.15, 205.11, 205.13, 205.14, 205.17

[56] References Cited

U.S. PATENT DOCUMENTS

| | | | |
|---|---|---|---|
| 1,983,475 | 12/1934 | LeMoine | 128/202.26 |
| 2,075,193 | 3/1937 | Gerson | 128/204.13 |
| 3,277,890 | 10/1966 | Warncke | 128/205.12 |
| 3.955,931 | 5/1976 | Thompson | 128/202.26 |

FOREIGN PATENT DOCUMENTS

| | | | |
|---|---|---|---|
| 865596 | 3/1941 | France | 128/202.26 |
| 223592 | 11/1968 | U.S.S.R. | 128/202.26 |

*Primary Examiner*—Henry J. Recla

*Attorney, Agent, or Firm*—McGlew and Tuttle

[57] ABSTRACT

An emergency respirator for rapid use by a person comprises a container having a cartridge for material which acts to bind carbon dioxide and to liberate oxygen to gases which pass therethrough. A breathing connection is connected to one end of the container preferably comprises a bellows-like hose which terminates at its outer end in a mouthpiece and defines a breathing passage interconnected into the cartridge. A jacket defines a heat storage connection to the opposite end of the container which is openable to atmosphere and expiration gases pass through the cartridge and are heated by the binding of the carbon dioxide and this heat is stored in the heat storage. Inspiration gases are then directed through the opening of the heat storage through the heat storage where they are heated before passing through the cartridge to liberate oxygen so that the incoming inspiration gases are enriched with oxygen and heated before they are delivered to the person.

4 Claims, 1 Drawing Figure

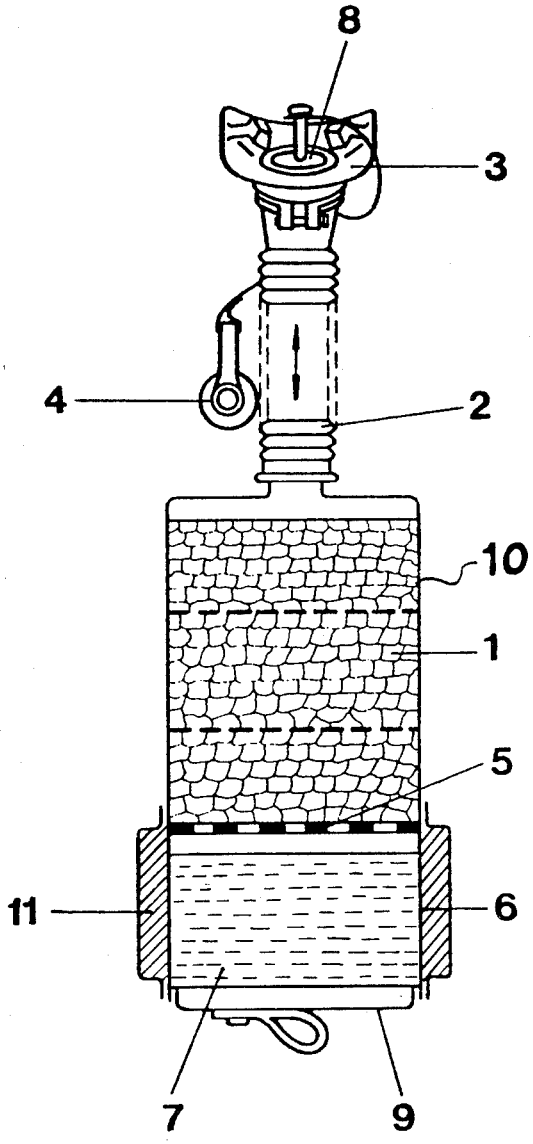
8
3
4
2
10
1
5
11
6
7
9

EMERGENCY RESPIRATOR

FIELD AND BACKGROUND OF THE INVENTION

This invention relates in general to respirators and in particular to a new and useful emergency respirator construction.

In climatically unfavorable environments such as in diving chambers and U-boats, the O2 supply may fail in breakdown of the supply installations and there may be additional excessive cooling due to respiration. This difficult situation should be avoided as simply and safely as possible.

In a known respirator it is important to prevent the heat loss generated over the respiration, as it is caused to a great part by the evaporation of water in the lungs and air ducts. This becomes rapidly very vital in breathing at high levels, wherein the breaths follow each other necessarily in rapid succession. The respirator consists of a pack of metal screens which are arranged on an oxygen mask in a housing of poor thermal conductivity. The breathing is effected in pendulum operation. The body heat transported with the expiration air is stored in the metal screens and subsequently returned to the mask wearer with the inspiration air. The applicability of this respirator is only possible in environments which contain otherwise breathable air, independent of the temperature conditions. Compensation of a lack of oxygen is not possible. (British Pat. No. 416 409).

SUMMARY OF THE INVENTION

The invention provides a simple emergency respirator which provides the wearer in a failure of the installations both with breathable inspiration air, and which prevents heat losses during the respiration.

In accordance with the invention, the emergency respirator for rapid use by a person comprises a container which has a cartridge of a material which acts to bind carbon dioxide and to liberate oxygen and to generate heat when the respiration gases are passed therethrough and the carbon dioxide is bound. The breathing connection is connected to one end of the container and defines a breathing passage through the container which terminates in a mouthpiece at its opposite end which may be inserted in the person's mouth. A jacket defines a heat storage or heat storing mass connected to the opposite end of the container and in an emergency this may be opened to the atmosphere. The mouthpiece is positionable in the person's mouth and expiration gases are directed by the person during expiration through the breathing passage and the cartridge to cause the production of heat by the binding of the carbon dioxide by the cartridge. This heat is directed into the heat storage and during inspiration, the inspiration gases are heated and then passed through the cartridge to pick up oxygen which is directed through the breathing passage to the person.

The essential advantages of the emergency respirator manifest themselves in a double action, namely by O2 supply for the wearer and the utilization of the heat of reaction from the cartridge to prevent cooling of the breathing organs of the wearer. This is done in the respirator in a safe and simple manner for the user. The necessary amount of oxygen is given off to the immediate surrounding with the expiration and inhaled again from there with the next breath. The amount of heat stored in the heat storage from the expiration air is withdrawn again with the next inspiration breath, and fed again to the wearer. The design of the apparatus is very simple, since no breathing bag is required. The additional external heat insulation about the cartridge jacket at the level of the heat storage enhances the heat storing effect in a simple manner.

Accordingly it is an object of the invention to provide an emergency respirator which includes a container connected to a mouthpiece defining a breathing passage which has a material which binds carbon dioxide and liberates oxygen so that respiratory gases passing therethrough will be collected in a heat storage connected to the opposite end of the container so that they may be heated by the heat generated by the binding of the CO2 and enriched with oxygen which are delivered back to the user.

A further object of the invention is to provide an emergency respirator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a somewhat schematic sectional view of an emergency respirator constructed in accordance with the invention.

DESCRIPTION OF THE PREFERRED EMBODIMENT

Referring to the drawing in particular the invention embodied therein comprises an emergency respirator for use by a person which includes a container 10 having a cartridge of a material which acts to bind carbon dioxide and to liberate oxygen to gases passing therethrough and designated 1. A breathing connection 2 is connected to one end of the container 10 and defines a breathing passage therethrough terminating in a mouthpiece 3 at its opposite end. A jacket 6 defines a space for a heat storage mass connected to the opposite end of the container 10 and this may be opened to atmosphere by tearing off a tear off lid 9 at the end of the jacket 6 which faces away from the container 10. In accordance with the invention, when the device is used by placing the mouthpiece in the person's mouth expiration gas is directed by the person during expiration through the breathing passage and the cartridge to cause the production of heat by the binding of the carbon dioxide of the respiratory gases and this heat is directed into heat storage mass 7. During inspiration the inspiration gases are heated in the heat storage mass 7 and directed to the cartridge to pick up additional oxygen before returning through the breathing passage 2.

The respirator contains a CO2 binding and O2 generating cartridge 1 with a known internal structure, to which is connected over an accordeon tube a mouthpiece 3 with a nose clamp 4. Cartridge 1 has on its bottom 5, held by cartridge jacket 6, a heat storage mass 7. The material of heat storage mass 7 is a highly porous aluminum cylinder.

The emergency respirator is protected at mouthpiece 3 by a plug 8, and at the end of cartridge jacket 6 by a tear off lid 9 in the rest period prior to the penetration of moisture.

When the emergency situation occurs, the apparatus is opened by removing plug 8 and lid 9, and can then be ventilated. The ventilation is effected according to the pendulum principle. During the expiration, the CO2 from the expiration air is bound in the cartridge and O2 and heat is generated at the same time. The generated heat is stored in heat storage mass 7, while it flows through the expiration phase, and then flows into the inspiration air during the inspiration phase, heating the incoming inspiration air.

The user of the emergency respirator is thus provided with oxygen, and at the same time protected against excessive cooling, since he takes in the preceding heat of reaction with the inspiration current.

An external jacket insulation 10 at the level of heat storage mass 7 about cartridge jacket 6 compliments the jacket in its heat storing action.

While a specific embodiment of the invention has been shown and described in detail to illustrate the application of the principles of the invention, it will be understood that the invention may be embodied otherwise without departing from such principles.

What is claimed is:

1. An emergency respirator for use by a person, comprising: a container having opposite open ends; a cartridge of a material in said container which acts to bind carbon dioxide and to liberate oxygen for gases passing through said container; a breathing connection connected to one open end of said container and defining a breathing passage; a mouthpiece connected to said breathing connection; a jacket having opposite open ends defining a heat storage space having one end connected to an opposite open end of said container; and a heat storage mass in said jacket; said mouthpiece being engageable in the person's mouth and expiration gases being directable during expiration through the breathing passage into the cartridge to cause a production of heat which is directed to said heat storage means, and during inspiration, inspiration gases are heated in said heat storage mass; said container having a perforated bottom in its connection to said one end of said jacket; and a tear off lid covering the opposite end of said jacket remote from said container.

2. An emergency respirator according to claim 1, wherein said heat storage mass comprises a porous aluminum cylinder.

3. An emergency respirator according to claim 1, including an insulation extending over said jacket.

4. An emergency respirator according to claim 1, wherein said breathing connection comprises a flexible tube having a bellows formation, said mouthpiece including a central opening with a closure plug therein which is removable.

* * * * *